US007937835B2

(12) United States Patent
Anderson et al.

(10) Patent No.: US 7,937,835 B2
(45) Date of Patent: May 10, 2011

(54) COMPOSITE CERAMIC SUBSTRATE FOR MICRO-FLUID EJECTION HEAD

(75) Inventors: Frank Edward Anderson, Sadieville, KY (US); Michael John Dixon, Richmond, KY (US); Eric Spencer Hall, Lexington, KY (US); Elios Klemo, Lexington, KY (US); Bryan Dale McKinley, Lexington, KY (US); Jeanne Marie Saldanha Singh, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/697,308

(22) Filed: Feb. 1, 2010

(65) Prior Publication Data

US 2010/0132874 A1 Jun. 3, 2010

Related U.S. Application Data

(62) Division of application No. 11/757,573, filed on Jun. 4, 2007, now Pat. No. 7,681,991.

(51) Int. Cl.
*B21H 1/08* (2006.01)
*B41J 2/05* (2006.01)

(52) U.S. Cl. ..... 29/890.1; 29/846; 29/851; 347/56; 347/63; 347/65

(58) Field of Classification Search ..... 29/890, 29/1, 831, 842, 846, 852, 890.1, 851; 347/56, 347/63, 65

See application file for complete search history.

(56) References Cited

U.S. PATENT DOCUMENTS

| | | | | |
|---|---|---|---|---|
| 6,000,787 | A * | 12/1999 | Weber et al. | 347/65 |
| 6,435,653 | B1 | 8/2002 | Boyd et al. | |
| 6,502,926 | B2 * | 1/2003 | Cook et al. | 347/63 |
| 6,543,880 | B1 | 4/2003 | Akhavain et al. | |
| 6,749,288 | B2 * | 6/2004 | Ahne et al. | 347/56 |
| 6,857,186 | B2 * | 2/2005 | Lin et al. | 29/890.1 |
| 7,226,156 | B2 | 6/2007 | Boyd et al. | |
| 7,267,431 | B2 * | 9/2007 | Anderson et al. | 347/65 |
| 7,354,794 | B2 * | 4/2008 | Anderson et al. | 438/106 |

OTHER PUBLICATIONS

R. Kulke, M. Rittweger, P. Uhlig, and C. Gunner, "LTCC Multilayer Ceramic for Wireless and Sensor Applications," LTCC—An Introduction and Overview, IMST GmbH, Dec. 2001, pp. 1-8.

* cited by examiner

*Primary Examiner* — Cathy Lam

(57) ABSTRACT

A composite ceramic substrate for receiving an ejection head chip for a micro-fluid ejection head and a method for making the composite ceramic substrate. The substrate includes a high temperature previously fired ceramic base having a substantially planarized first surface and at least one fluid supply slot therethrough. A low temperature co-fired ceramic (LTCC) tape layer bundle having at least two LTCC tape layers is attached to the ceramic base at an interface between the LTCC tape layer bundle and the first surface of the ceramic base. The LTTC tape layer bundle has at least one chip pocket therein and at least one of the LTCC tape layers includes a plurality of conductors.

10 Claims, 6 Drawing Sheets

COMPOSITE CERAMIC SUBSTRATE FOR MICRO-FLUID EJECTION HEAD

CROSS REFERENCE TO RELATED APPLICATIONS

This is a divisional application of U.S. patent application Ser. No. 11/757,573 filed Jun. 4, 2007 now U.S. Pat. No. 7,681,991, entitled "COMPOSITE CERAMIC SUBSTRATE FOR MICRO-FLUID EJECTION HEAD."

FIELD OF THE DISCLOSURE

The present disclosure is generally directed toward micro-fluid ejection heads. More particularly, in an exemplary embodiment, the disclosure relates to the manufacture of micro-fluid ejection heads utilizing non-conventional, ceramic substrates.

BACKGROUND AND SUMMARY

Multi-layer circuit devices such as micro-fluid ejection heads have a plurality of electrically conductive layers separated by insulating dielectric layers and applied adjacent to a substrate, typically a semiconductor substrate. Thermal energy generators or heating elements, usually resistors, are located on an ejection head chip and are for heating and vaporizing fluid to be ejected.

Micro-fluid ejection devices such as ink jet printers continue to experience wide acceptance gas economical replacements for laser printers. Micro-fluid ejection devices also are finding wide application in other fields such as in the medical, chemical, and mechanical fields. As the capabilities of micro-fluid ejection devices are increased to provide higher ejection rates, the ejection heads, which are the primary components of micro-fluid ejection devices, continue to evolve and become larger, more complex, and more costly to manufacture.

One significant obstacle to be overcome in micro-fluid ejection head manufacturing processes is maintaining the planarity of the ejection device substrate, also referred to as the ejection chip, and the nozzle plate during and after the manufacturing process. The planarity of the ejection chip and the nozzle plate, (hereainafter referred to as "ejection head chip") determines the direction in which a fluid such as ink is dispensed. If the nozzle plate is warped or bowed, due to warping or bowing of the underlying ejection device substrate, the desired direction of fluid-jetting is compromised. The planarity of these components may be affected by mismatched coefficients of thermal expansion between the various members of the ejection head, including the nozzle plate, the device substrate, the base support, and any adhesive material used in securing the aforementioned components to one another.

Current manufacturing processes are limited by the size of the ejection head substrate used to provide a single ejection head chip. In order to provide higher speed or quantity of fluid election, larger ejection heads are needed. Larger ejection heads may be provided by attaching multiple chips to a single substrate. However, mounting multiple chips on a single substrate increases the difficulties of maintaining manufacturing tolerances. For example, the difficulty of maintaining the planarity and manufacturing tolerances of multiple chips on a substrate is greatly increased as the number of chips on a substrate increases.

During the manufacturing process, a polymeric die attach adhesive is typically used to secure the components of the ejection head to one another. However, such adhesives require thermal curing which causes expansion and contraction of the components and may lead to warping or bowing of the ejection device substrate and the nozzle plate. Alterations in the thickness of the adhesive layer or the thickness of the underlying support material have led to only marginal improvements in the planarity of the finished devices.

Ceramic substrates, commonly high purity alumina, have been used for mounting multiple ejection head chips because of their dimensional stability and rigidity. Ceramic substrates are generally formed in a "green", pliable, unfired state and then fired prior to mounting the chips on the substrate. During firing, shrinkage occurs, leading to poor control over dimensional tolerances in the as-fired state. Accordingly, subsequent lapping may be required to provide a suitably planar surface for mounting the ejection head chips.

Another tolerance parameter for mounting multiple ejection head chips on a single substrate is that the ejection head chips have bond pads on the same surface as the ejectors for connection to wiring typically provided on a flexible circuit or printed circuit board (PCB). Accordingly, it is desirable for the surface surrounding the ejection bead chips to be in substantially the same plane as the ejector surface for effective wiping, maintenance, and capping. Therefore chips have often been mounted in recessed "pockets" to facilitate maintenance functions and to allow for interconnection to wiring. Providing a planar die attach surface for mounting multiple chips in recessed pockets is difficult and increases the difficulty of manufacturing large, multi-chip ejection heads. Accordingly, there is to need to improve the manufacturing techniques and tolerances for making multi-chip micro-fluid ejection devices.

In view of the foregoing and other needs an exemplary embodiment of the disclosure provides a composite ceramic substrate for receiving, an ejection head chip or chips for a micro fled ejection head. The substrate includes a ceramic base having a substantially planarized first surface and at least one fluid supply slot therethrough. A low temperature co-fired ceramic (LTCC) tape layer bundle baying at least two LTCC tape layers is attached to the ceramic base at an interface between the LTCC tape layer bundle and the first surface of the ceramic base. The LTTC tape layer bundle has at least one opening therein providing side walls of a chip pocket when attached to the ceramic base and at least one of the LTCC tape layers includes a plurality of conductors for providing electrical connections to the ejection head chip in the chip pocket.

Another exemplary embodiment of the disclosure provides a method for fabricating a micro-fluid ejection head structure. According to the method, conductors are applied to a surface of at least one low temperature co-fired ceramic (LTCC) tape layer having a chip pocket opening therein. A bundle of two or more green LTCC tape layers having chip pocket openings therein including the LTCC tape layer having the conductors thereon is formed. The bundle of LTCC tape layers is attached to a substantially planarized surface of a previously fired ceramic base to provide a composite ceramic structure. The composite ceramic structure is then fired at a temperature ranging from about 800° to about 1000° C. to provide the micro-fluid ejection head structure having encapsulated conductors therein.

An advantage of the composite ceramic structure according to the disclosure is that a substantially planar surface of a previously fired ceramic material base may be provided for improved planarity of micro-fluid ejection head chips attached to the base. Additionally, the LTCC layer bundle provides improved encapsulation of conductors after tiring the ceramic base. Use of LTCC layers to provide the LTCC layer bundle also enables the use of relatively low resistance conductor material to provide the encapsulated conductors lines.

By comparison, micro-fluid ejection heads using substrates made of high temperature co-fired (HTCC) tape layers, as described in U.S. Patent Publication Nos. 2002/0033861, 2004/0113996, and U.S. Pat. No. 6,543,880, are tired at temperatures of about 1600' C. and thus require the use of refractory metals that have relatively high resistance. Use of the LTCC layers for encapsulating the conductors enables the use of relatively lower firing temperatures and the use of non-refractory metals for conductors. Another advantage of the LTCC layers is that LTCC materials are available that have a shrinkage rate in the X-Y plane of than about 1%. Since the LTCC layers may be laminated to a base ceramic substrate at temperatures substantially below 1600° C., dimensional changes and/or warpage of the base ceramic and delamination between the base ceramic and LTCC layers is minimized.

BRIEF DESCRIPTION OF THE DRAWINGS

Further advantages of exemplary embodiments disclosed herein may become apparent by reference to the detailed description of the embodiments when considered in conjunction with the drawings, which are not to scale, wherein like reference characters designate like or similar elements throughout the several drawings as follows.

DESCRIPTION OF THE EXEMPLARY EMBODIMENTS

As described in more detail below, the exemplary embodiments disclosed herein relate to non-conventional substrates for providing planarized micro-fluid ejection heads for micro-fluid ejection devices such as ink jet printers and the like. Such non-conventional substrates, unlike conventional silicon substrates, may be used to provide large arrays of micro-fluid ejection actuators on a single substrate. For example, relatively long composite ceramic substrates may be used to provide page wide ink jet printers and other large format fluid ejection devices.

Components of the composite ceramic structure include two or more low temperature co-fired ceramic (LTCC) tape layers and a previously fired ceramic base material. An LTCC tape layer bundle made from the LTCC tape layers also includes relatively low resistance conductors encapsulated therein to provide electrical connections for micro-fluid ejection head chips attached to the composite substrate.

Figure 1:
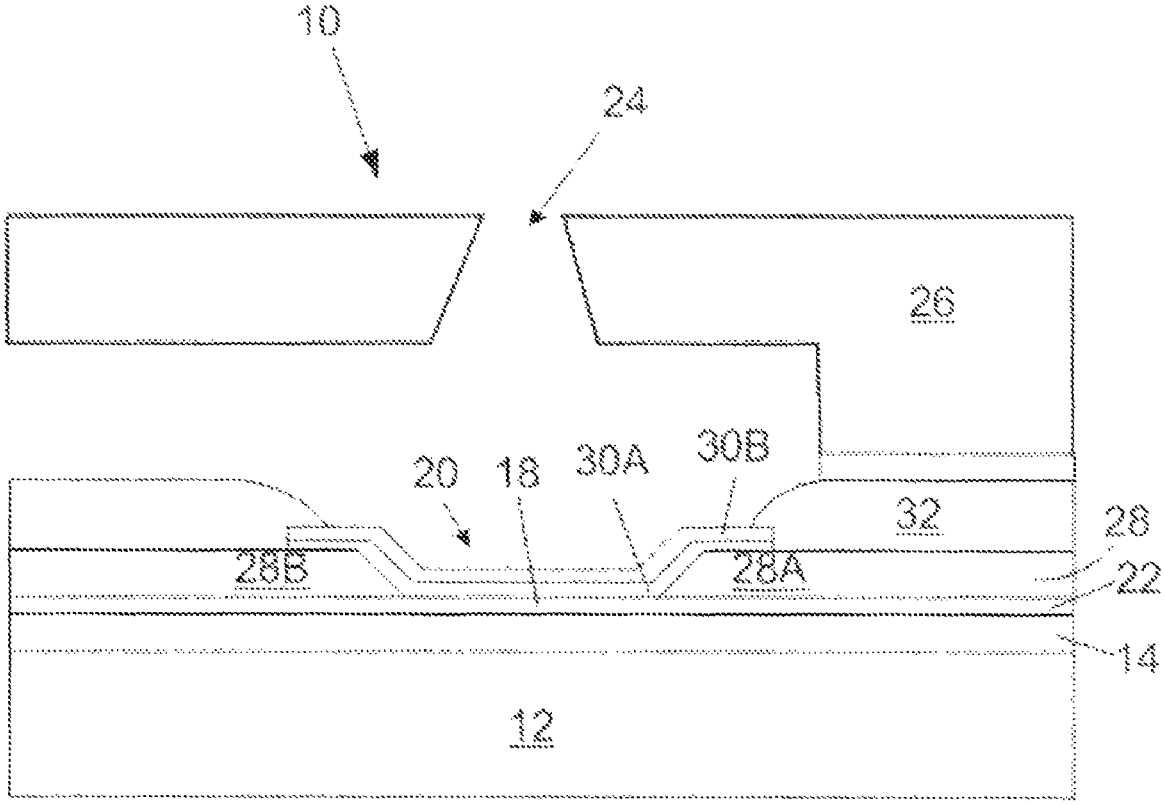
FIG. 1 is a representational cross-sectional view, not to scale, of a micro-fluid ejection head that may be attached to a composite ceramic base according to the disclosure.

Micro-fluid ejection head chips 10 that may be attached to the substrate are illustrated in FIG. 1. The micro-fluid ejection head chips 10 may be an ink jet printhead or other micro-fluid ejection head. The ejection head chips 10 typically include a conventional substrate 12 such as a silicon substrate or other semiconductor substrate that is processed to include an insulating layer 14.

In a manner well known to those skilled in the art, thermal fluid ejectors 18, such as heater resistors, are formed in an actuator region 20 of the substrate 12 from a heater resistor layer 22 adjacent to the insulating layer 14. Upon activation of the thermal fluid ejectors 18 in the actuator region 20, fluid supplied from a fluid source through fluid paths in an associated fluid reservoir body and corresponding fluid flow slots in the substrate 12 is caused to be ejected toward a media through nozzles 24 in a nozzle plate 26 associated with the substrate 12. Each fluid supply slot may be machined or etched in the substrate 12 by conventional techniques such as deep reactive ion aching, chemical etching, sand blasting, laser drilling, saying, and the like, to provide fluid flow communication from the fluid source actuator region 20 of the ejection head chips 10. A plurality of fluid ejectors 18 are conventionally provided adjacent to one or both sides of the fluid supply slots.

In order to activate the fluid ejectors 18, an electrically conductive layer 28 is applied adjacent to the substrate 12. The conductor layer 28 is etched to provide an anode 28A and a cathode conductor 28B for the ejectors 18. The heater resistor layer 22 and the conductor layer 28 may be patterned and etched using well known semiconductor fabrication techniques to provide a plurality of the fluid ejectors 18 on the substrate 12. Suitable semiconductor fabrication techniques include, but are not limited to, micro-fluid jet ejection of conductive inks, sputtering, chemical vapor deposition, reactive ion etching, laser etching, and the like.

Passivation/cavitation layers 30A and 30B may be provided in the actuator region 20 in a manner well known in the art to protect the ejectors 18 from contact with the fluids being ejected. An insulating or dielectric layer may be applied adjacent to the conductor layer 28 to provide electrical insulation and protection of the conductor layer 28. The nozzle plate 26 having the nozzles 24 may be attached adjacent to the layer 32 in a manner well known to those skilled in the art. As described in more detail below, the composite ceramic substrate according to the disclosure may be configured for one or more micro-fluid ejection head chips 10 attached thereto.

Figure 2A:
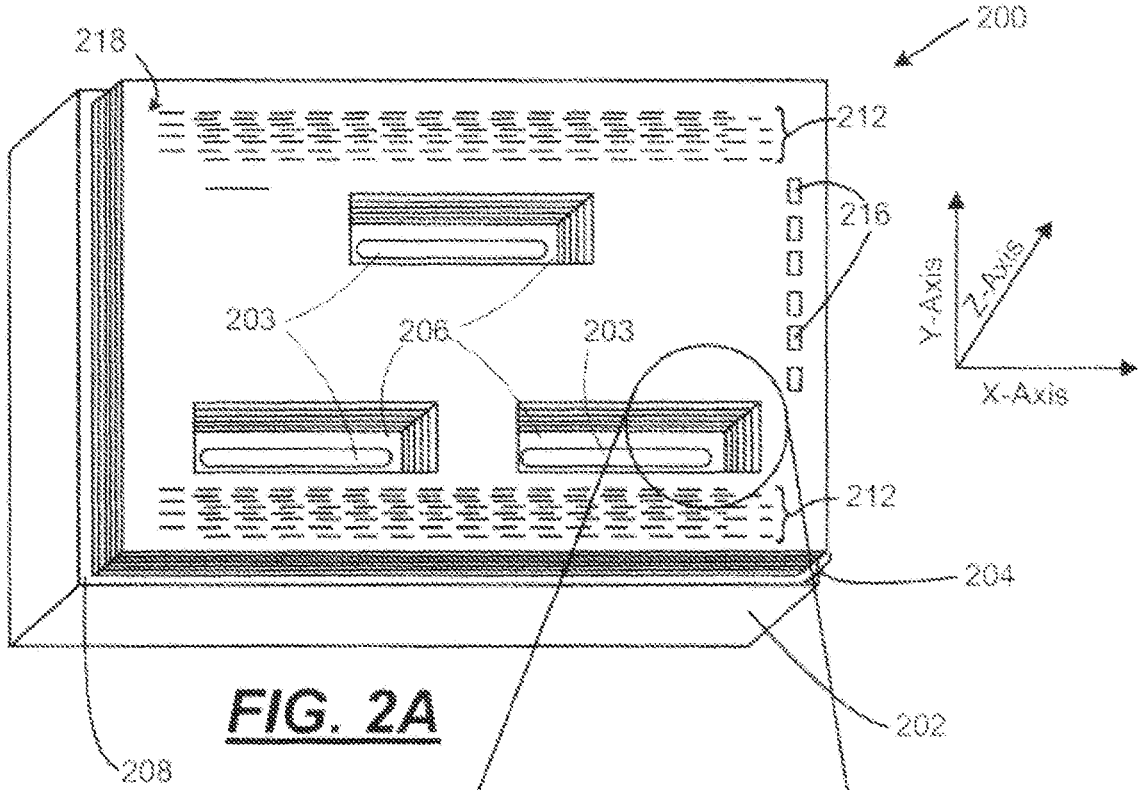
FIG. 2A is a perspective view, not to scale, of a composite ceramic substrate according to an embodiment of the disclosure.
Figure 2B:
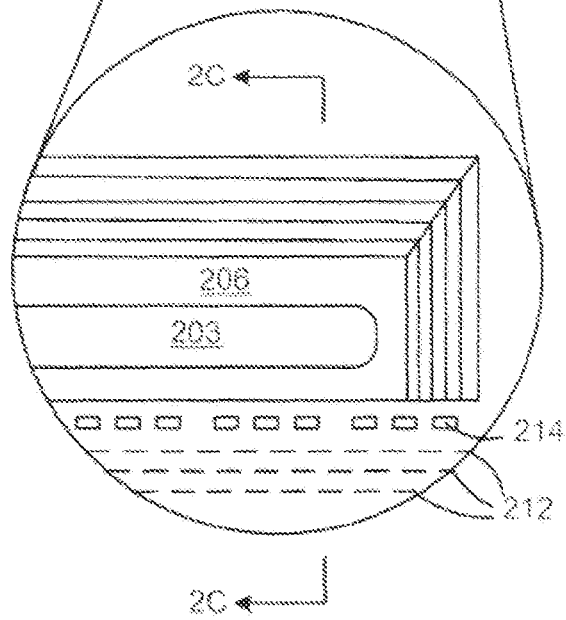
FIG. 2B is an enlarged plan view, not to scale, of a portion of the composite ceramic substrate of FIG. 2A.
Figure 2C:
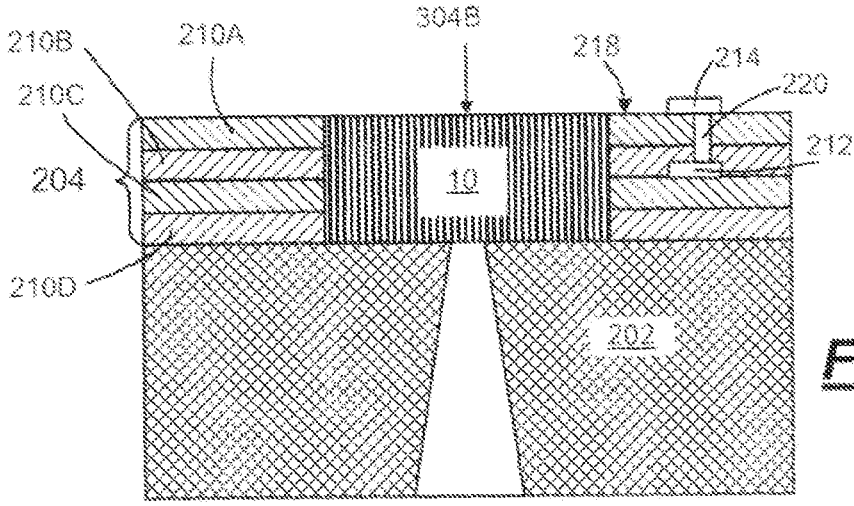
FIG. 2C is an enlarged cross-sectional view, not to scale, of the portion of the composite ceramic substrate of FIG. 2B.
Figure 3:
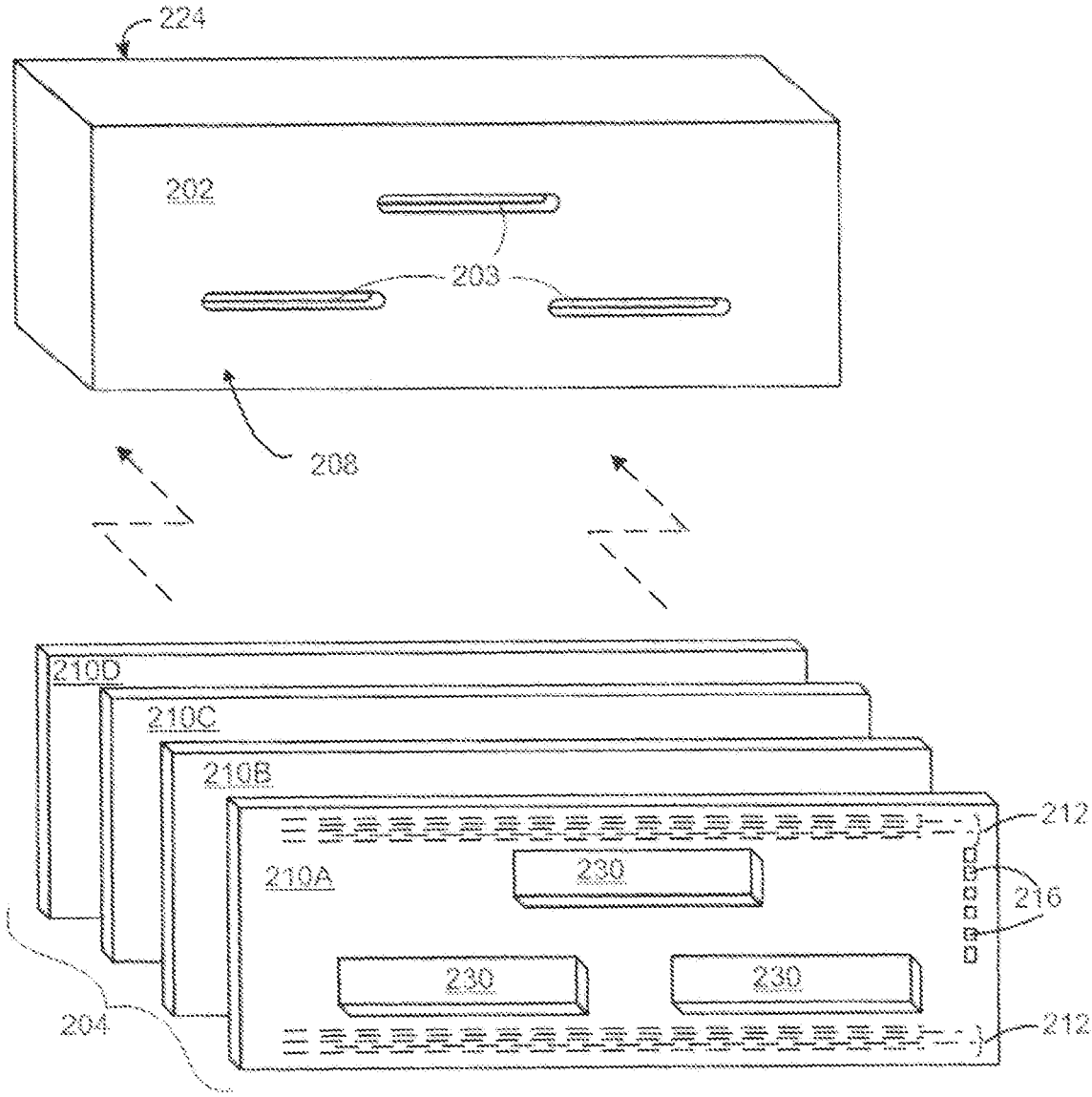
FIG. 3 is a perspective exploded view, not to scale, of a composite ceramic substrate according to an embodiment of the disclosure.

With reference now to FIGS. 2 and 3, there is shown, in perspective views, a composite ceramic substrate 200 according to the disclosure. In some embodiments, the substrate 200 includes is a ceramic base component 202 made of a high purity alumina or other ceramic material, and a laminate component 204 made of a material such as a low temperature co-fired ceramic (LTCC), or printed circuit board (PCB). The laminate component 204 may be made from two or more LTCC tape layers 210 that include embedded conductors 212, as described in more detail below. Contact pads 214 and 216 may be provided on an exposed surface of 218 of LTCC layer 210B. As shown in FIG. 2C, conductive vias 220 may also be provided for electrical connection between the conductive lines 212 and the contact pads 214 or 216 on the surface 218 of the composite substrate 200.

In some exemplary embodiments, the ceramic base component 202 may be provided by a material that includes between about 92 and about 99 weight percent alumna. In other exemplary embodiments, the ceramic base component 202 may be made of greater than about 99 percent alumina. The ceramic base component 202 is suitably a high temperature ceramic material that is fired at or above 1,200° C. to provide a previously fired ceramic base component 202 of the substrate 200. The ceramic base component 202 includes one or more fluid supply slots 203 formed therein, which define a plurality of fluid pathways from a fluid supply reservoir to the ejection head chips 10 attached to the substrate 200. The fluid supply slots 203 may be formed by conventional micro-machining techniques such as milling, laser ablation, chemical etching, reactive ion etching, sand blasting, molding, and the like. An alternative to the single layer previously fired high purity ceramic base is a base comprised of layers of high temperature co-fired ceramic (HTCC) tape laminated and co-fired to provide the base 202. In the alternative base green sheet layers of the HTCC material may be pre-punched to provide the slots 203 and then combined and fired to form the ceramic base 202. The previously fired ceramic base component 202 also has at least one substantially planarized surface 208. The planarized surface 208 insures that the nozzles 24 of the ejection chips 10 all lie in substantially the same plane.

The low temperature co-fired ceramic (LTCC) material is selected for its characteristic low shrinkage in an X-Y plane. For example, the LTCC material may be selected from materials having a shrinkage of no more than about 1.0 percent in the X-Y plane and more particularly no more than about 0.5 percent in the X-Y plane. Particularly suitable LTCC materials may be selected from materials having a shrinkage of about 0.16 percent in the X-Y plane. In some embodiments, the LTCC tape layer 204 may include a built-in constraining layer for reducing an amount of stress and warping at the interface between the LTCC tape layer 204 and the ceramic base 202.

The laminate component 204 is also desirably provided by LTCC tape layers 210 having conductors 212 embedded in the layers for providing electrical connections to the ejection chip 10 attached to the substrate 200. In some embodiments, the plurality of conductors 212 may be formed by a screen printing process or a digital printing process. In an alternative embodiment, trenches may be milled or otherwise formed in the LTCC tape layers 210 and the trenches filled by conductive materials by stencil printing or other via filling techniques to provide the conductors 212. When using LTCC tape materials to provide the tape bundle 204, conductors 212 may be made of non-refractory metals that have relatively low resistance compared to refractory metals. Such non-refractory metals include, but are not limited to silver, gold, copper, nickel, platinum, palladium, alloys of two or more of the foregoing, and the like which may not require plating for improving connections made to the ejection head chips 10 or other components. A particular advantage of the LTCC tape layers 210 is that during firing a glass fraction of the LTCC tape layers 210 melts and flows to provide enhanced sealing and/or encapsulation of the conductors 212.

Chip pockets 206 are provided in the laminate component 204 for receiving the ejections heads 10. The tape layers 210 may be, micro-machined or pre-punched to provide openings 230 (FIG. 3) that provide the chip pockets 206 upon lamination and tiring of the tape layers 210. A number of LTCC tape layers 210 is chosen to accommodate an overall thickness of the ejection head chip 10 and any adhesive that may be used to attach the chip 10 to the substrate 200.

The chip pockets 206 in the laminate component 204 are aligned and mated with the planarized surface 208 of the previously tired base component 202 to provide the substrate 200. In some exemplary embodiments, an interfacial adhesion layer, such as a scaling glass or co-firable dielectric paste material, may be applied between the previously fired ceramic base 202 and the laminate component 204 to enhance adhesion between the base 202 and component 204. The combination of the previously tired ceramic base 202 and the laminate component 204 may then be fired at temperatures ranging from about 800° to about 1000° C. to provide the substrate 200.

In an alternative embodiment, each of the laminate component 204 and the ceramic base component 202 are tired before combining the components to provide the composite substrate 200. In that case, an interfacial adhesion layer, such as a sealing glass, a polymeric adhesive, or the like, may be used to fixedly attach the laminate component 204 to the base component 202. When fired components 204 and 202 are combined, a temperature lower than about 800° C. may be used to fixedly bind the components 204 and 202 to one another depending on the melting temperature of an interfacial adhesion layer that is used.

Figure 4:
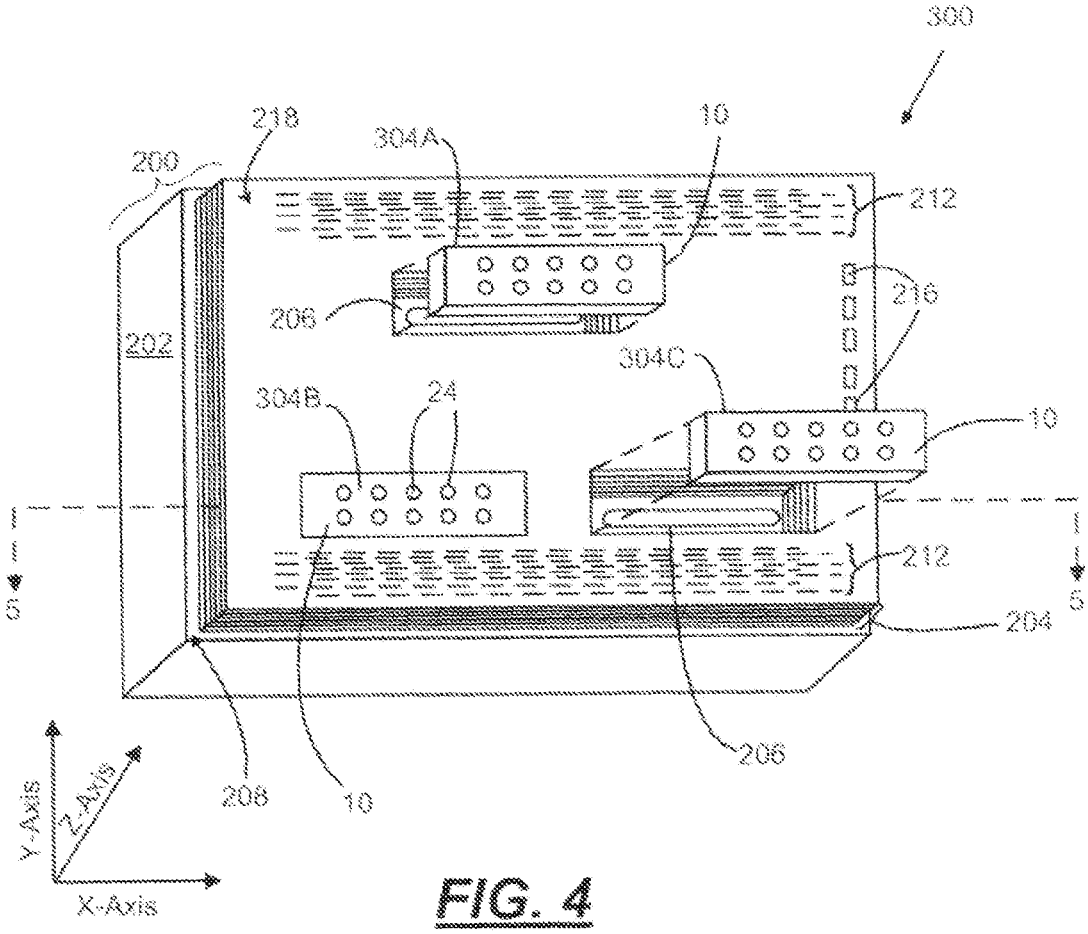
FIG. 4 is a perspective view, not to scale, of a composite ceramic substrate and ejection head chips according to an embodiment of the disclosure.

As shown in FIG. 4, a micro-fluid ejection head 300 may include the substrate 200 including the ceramic base 202 and the laminate component 204, and one or more ejection head chips 10, as described above. The embedded conductors 212 in the laminate component 204 may be connected to the ejection head chips 10 to provide control of the ejectors 15 on the chips 10 for each of the nozzles 19. For example, the embedded conductors 212 may be connected to the ejection head chips 10 using wire bonding techniques between the contact pads 214 and the chips 10.

Each of the election head chips 10 has an upper surface 304A-304C containing the nozzles 24. The substrate 200 in FIG. 4 includes three election head chips 10 for illustrative purposes only. In other embodiments, the substrate 200 may include fewer or more chip pockets 206 with fewer or more ejection head chips 10 attached in the chip pockets 206 to the substrate 200.

When the ejection head chips 10 are attached within the chip pockets 206 to the substrate 200, each surface 304A-304C of the chips 10 is substantially parallel to the surface 218 of the substrate 200 along the X-Y plane. The surfaces 304A-304C and 218 also desirably lie within the same X-Y plane as a result of the chips 10 being attached to the planarized surface 203 of the ceramic base 202.

Figure 5:
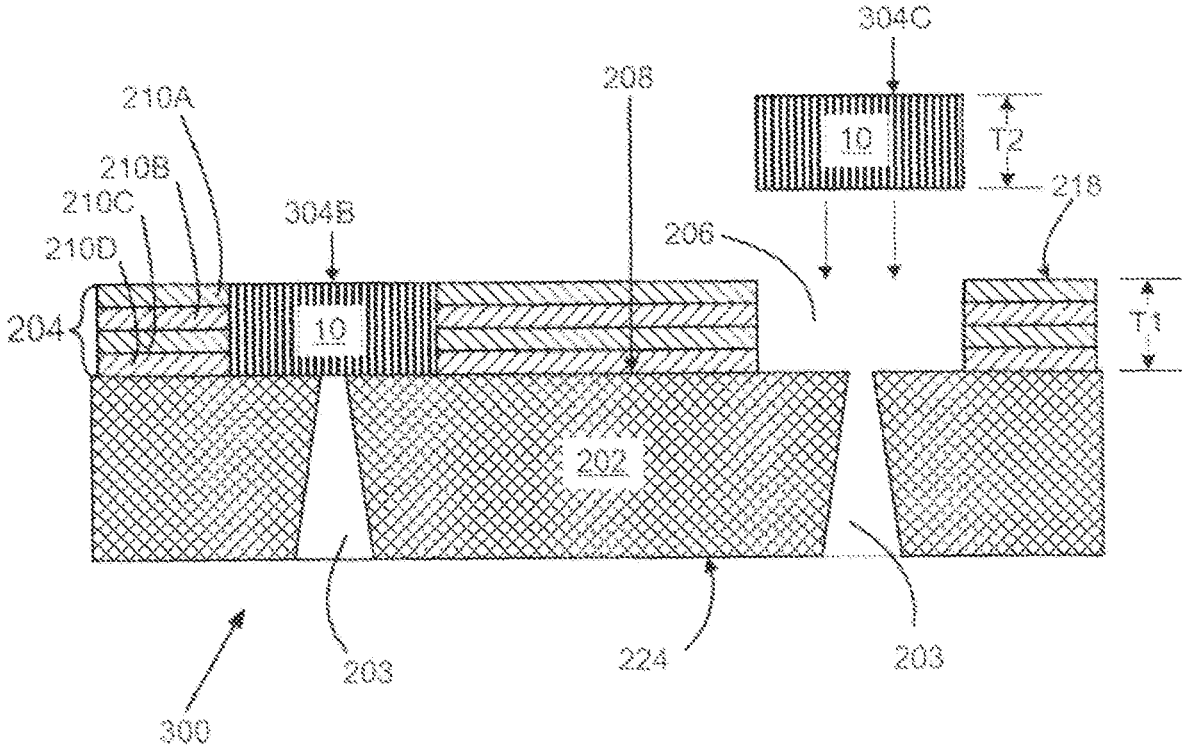
FIG. 5 is cross-sectional view, not to scale, along lines 5-5 of FIG. 4 illustrating a relative thickness of LTCC tape layers, ceramic base, and ejection head chips for an ejection head according to the disclosure.

FIG. 5 is cross-sectional view taken along lines 5-5 in FIG. 4. As shown in FIG. 4, ejection head chips 10 are deposited into the pockets 206 and attached to the substrate 200 typically with an adhesive. As discussed above, the substrate 200 includes the previously fired ceramic base component 202 and the laminate component 204 provided by two or more LTCC tape layers 210A-210D, for example, attached to the planarized surface 208 of the ceramic base component 202. One or more of the layers 210A-210D may include the embedded conductors 212.

Figure 6:
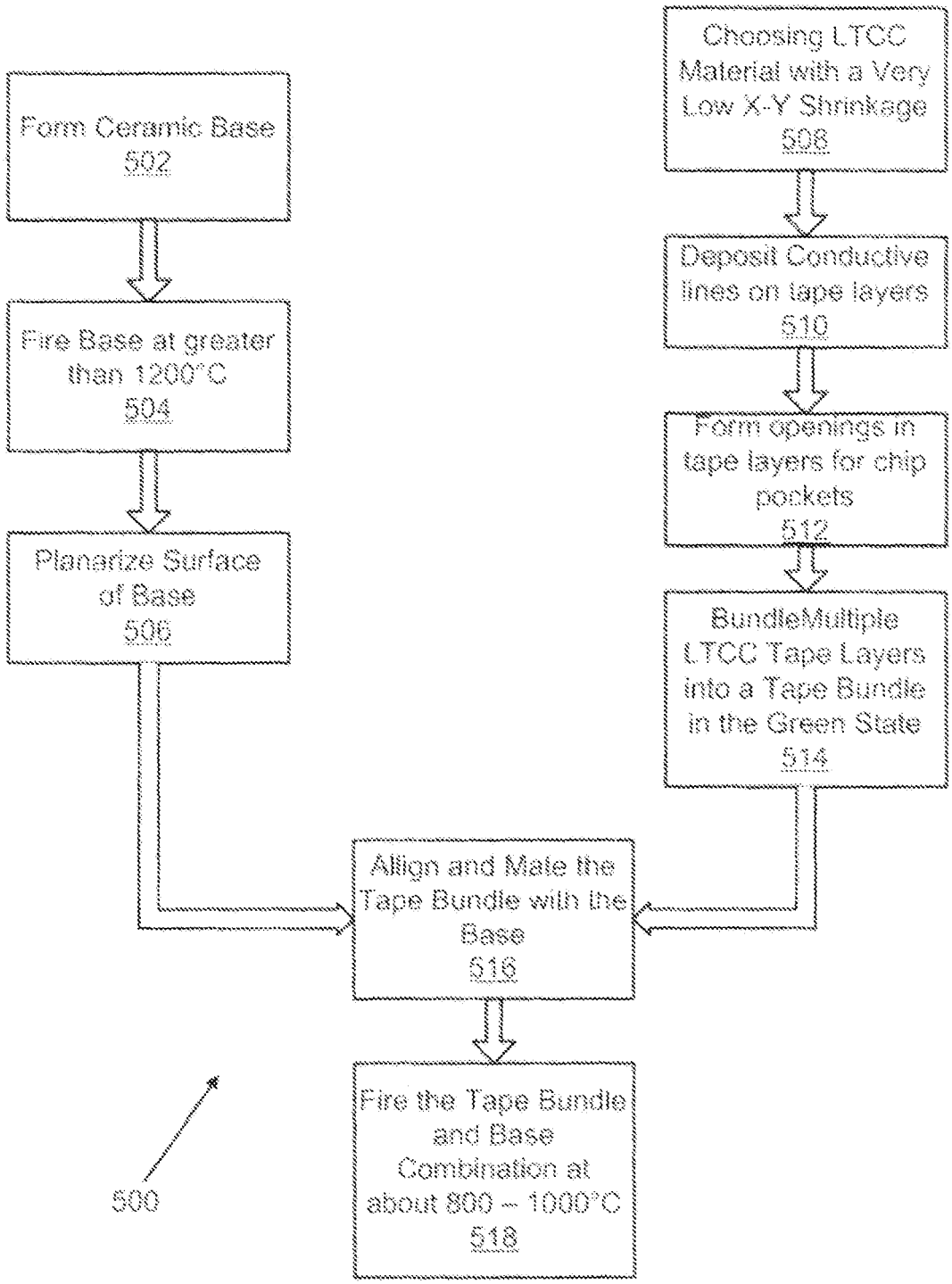
FIG. 6 is a flowchart of a method for fabricating a composite ceramic substrate according to the disclosure.

With reference to FIG. 6, a method 500 for making the composite substrate 200 is illustrated. Parallel or sequential processing of the laminate component 204 and the ceramic base 202 may be conducted prior to combining the base 202 and component 204 to form the substrate 200. FIG. 5 illustrates parallel process of the substrate 200, however, the disclosed embodiments are not limited to parallel processing.

The first step for forming the ceramic base 202 is represented by block 502. The base 202 is formed by molding or pressing a ceramic composition. After molding and pressing the materials, the base is fired at greater than about 1200° C. in step 504 of the process. In art exemplary embodiment, the ceramic base 202 may be provided by a material that ranges from about 92 to about 99 weight percent alumina, and in a particular exemplary embodiment, the material is greater than about 99 weight percent alumina.

Before or after the base 202 is fired, the fluid supply slots 203 are formed in the base 202. For example, the fluid supply slots 203 may be formed as the base 202 is molded or pressed. In another exemplary embodiment, the fluid supply slots 203 may be firmed after the base 202 is fired in step 504 by one or more of the micro-machining processes described above.

After the base 202 has been fired in step 504, the surface 208 of the base 202 is planarized and/or polished as necessary in step 506 to provide the substantially planarized surface 208 for attaching the chips 10 thereto. Conventional techniques such as lapping or grinding and polishing may be used in step 506 to planarize the surface 208 of the base 202. In some embodiments, only surface 208 is planarized. In other embodiments, the surface 224 opposite surface 208 of the base 202 is also planarized.

Steps for forming the laminate component 204 are illustrated as stops 508, 510 and 512 of the process, in step 508 a suitable low temperature co-fired ceramic (LTCC) material having a relatively low shrinkage in the X-Y plane is chosen. Numerous LTCC materials exist, but few have relatively low shrinkage in the X-Y plane that make the materials suitable for providing the composite ceramic substrate 200 described herein. For example, many LTCC materials have an X-Y shrinkage of greater than about 15%. A suitable material for making the composite substrate 200 is an LTCC material having less than about 1% shrinkage in the X-Y plane. In a particularly exemplary embodiment a material having, shrinkage ranging from about 0.5% in the X-Y plane is selected. An example of such material is an LTCC material available from Heraeus Inc., Circuit Materials Division of Germany under the trade name HERALOCK 2000. Such material may include a higher percentage of glass than the BASE material 202 described above. For example, the LTCC material may contain from about 30 to about 40 wt. % glass.

One or more of the tape layers 210A-210D of the LTCC material may have conductive material, such as the low resistance conductive material described above, deposited thereon in step 510 using a suitable printing technique. In step 512, openings 230 may be punched or otherwise machined in the layers 210A-210D by the techniques described to provide the chip pockets 206 when the laminate component 204 is attached to the ceramic base 202.

In step 514, the tape layers 210A-210D are assembled together to provide the laminate component 204. At this point in the process, the laminate component 204 is still in the green state, meaning that the LTCC materials in the laminate have yet to be tired.

The laminate component 204 is then aligned and mated with the previously tired base 202 in step 516 of the process so that the openings 230 in the laminate component 204 align with the fluid supply slots 203 in the base 202. The laminate component 204 may be attached to the base 202 using pressure and temperature by an isostatic laminator or other suitable laminating equipment. As described above, an interfacial adhesion layer may be used to fixedly attach the laminate component 204 to the base 202.

In an alternate exemplary embodiment, individual tape layers 210A-210D may be aligned and stacked onto the base 202 one at a time. In this embodiment, each individual tape layer 210A-210D is stacked carefully in order to eliminate all air entrapment between the tape layer 2100 and the base 202 or between individual tape layers 210A-210C. Each tape layer 210A-210D may be laminated individually in this embodiment.

Once the tape layers 210A-210D are laminated onto the base 202 using one of the processes discussed above, the composite base/laminate component 202/204 is fired at temperature ranging from about 800 to about 1000° C. as represented by block 518 to provide the composite substrate 200 including the previously fired base component 202 and the LTCC component 204. During firing, the tape bundle 204 adheres to the base 202. The resulting substrate 200 includes fluid supply channels 203, conductors 212 and chip pockets 206 for receiving the ejection head chips 10. During the firing step 518, glass in the LTCC component 204 flows over and around the conductors 212 to substantially completely embed the conductors 212 in the laminate component 204.

The firing of step 516 is done at temperatures low enough to ensure the base 202 is unaffected by the firing so that critical dimensions, such as the planarity of surface 208 or the X-Y dimensions of the base component 202 do not substantially change. Accordingly, the LTCC material providing the laminate component 204 may be fired into a hardened state during step 516 at a temperature below about 1000° C. without detrimental effect such as warpage, shrinkage, or expansion of the has 202. Accordingly, the planarity of the surface 208 of the base component 202 may be maintained while providing a laminate component 204 containing the conductors 212.

By contrast, the base material made of high purity alumina or HTCC materials may require temperatures in excess of 1600° C. for firing. Also, conductors may be provided in HTCC materials using high resistance metals such as molybdenum or tungsten, which may require plating for additional connections. Low resistance metals are not suitable for the high temperature firings required by high purity alumina or HTCC materials.

The ejection heads 300, described herein may be attached to a fluid reservoir body or other structure for feeding fluid to be ejected to the ejection head chips 10. For example, the election head 300 may be attached to a fluid cartridge body containing one or more fluids to be ejected or may be attached by means of fluid conduits to a separate fluid reservoir.

It is contemplated, and will be apparent to those skilled in the art from the preceding description and the accompanying drawings that modifications and/or changes may be made in the embodiments disclosed herein. Accordingly, it is expressly intended that the foregoing description and the accompanying drawings are illustrative of exemplary embodiments only, not limiting thereto, and that the true spirit and scope of thereof which may be determined by reference to the appended claims.

What is claimed is:

1. A method for fabricating a micro-fluid ejection head structure comprising:

applying conductors to a surface of at least one green low temperature co-fired ceramic (LTCC) tape layer having a chip pocket opening therein;

forming a bundle of two or more LTCC tape layers having chip pocket openings therein including at least one of the LTCC tape layers having the conductors thereon;

attaching the bundle of LTCC tape layers to a substantially planarized surface of a previously fired ceramic base to provide a composite ceramic structure having a chip pocket defined by the chip pocket openings in the LTCC tape layers; and firing the composite ceramic structure at a temperature sufficient to provide the micro-fluid ejection head structure having encapsulated conductors therein.

2. The method of claim 1, wherein the LTCC tape layer bundle comprises relatively low shrink LTCC tape layers relative to an X-Y plane of the surface of the ceramic base.

3. The method of claim 1, wherein the LTCC tape layer bundle comprises LTCC tape layers having a shrinkage of no more than about 0.5 percent in an X-Y plane substantially parallel to the surface of the ceramic base upon firing.

4. The method of claim 1, wherein a thickness of the LTCC tape layer bundle is substantially the same as a thickness of an ejection head chip attached to the ceramic base in the chip pocket.

5. The method of claim 1, wherein the step of attaching the LTCC tape layer bundle to the ceramic base comprises laminating the tape layer bundle to the base using heat and pressure.

6. The method of claim 1, further comprising applying an interfacial adhesion layer to an interface between the LTCC tape layer bundle and the ceramic base before attaching the LTCC tape layer bundle to the ceramic base.

7. The method of claim 1, further comprising attaching a micro-fluid ejection head chip to the ceramic base in the chip pocket.

8. The method of claim 1, wherein the composite structure comprises two or more chip pockets, further comprising attaching a micro-fluid ejection head chip in each of the chip pockets.

9. The method of claim 1, wherein the composite ceramic structure is fired at a temperature ranging from about 800° to about 1000° C.

10. The method of claim 1, wherein the bundle of LTCC tape layers is fired prior to attaching the bundle of LTCC tape layers to the ceramic base, and the composite ceramic structure is fired at a temperature sufficient to bond the LTCC tape layer bundle to the ceramic base.

* * * * *